US010856647B2

(12) United States Patent
Bartschi et al.

(10) Patent No.: US 10,856,647 B2
(45) Date of Patent: Dec. 8, 2020

(54) BRUSH, TOOTHBRUSH, AND ASSOCIATED PRODUCTION METHOD

(71) Applicant: TRISA HOLDING AG, Triengen (CH)

(72) Inventors: Armin Bartschi, Winznau (CH); Peter Gross, Sempach (CH)

(73) Assignee: TRISA HOLDING AG, Triengen (CH)

( * ) Notice: Subject to any disclaimer, the term of this patent is extended or adjusted under 35 U.S.C. 154(b) by 0 days.

(21) Appl. No.: 16/445,757

(22) Filed: Jun. 19, 2019

(65) Prior Publication Data

US 2019/0357666 A1 Nov. 28, 2019

Related U.S. Application Data

(60) Continuation of application No. 15/371,578, filed on Dec. 7, 2016, now Pat. No. 10,390,606, which is a (Continued)

(30) Foreign Application Priority Data

Sep. 22, 2004 (EP) ..... 04022614

(51) Int. Cl.
*A46B 11/00* (2006.01)
*A46B 15/00* (2006.01)
(Continued)

(52) U.S. Cl.
CPC ..... *A46B 11/0068* (2013.01); *A46B 11/0003* (2013.01); *A46B 11/0041* (2013.01);
(Continued)

(58) Field of Classification Search
CPC ..... A46B 11/0062; A46B 15/0091; A46B 11/0041; A46B 11/0003; A46B 3/00;
(Continued)

(56) References Cited

U.S. PATENT DOCUMENTS 1,060,524 A 4/1913 Wolfe
1,797,946 A 3/1931 Eichel
(Continued)

FOREIGN PATENT DOCUMENTS

BE 1001993 A7 5/1990
DE 29718117 U1 1/1998
(Continued)

OTHER PUBLICATIONS

Feb. 9, 2016 Extended European Search Report issued in European Patent Application No. 15 187 837.8.
Jan. 9, 2014 Office Action issued in U.S. Appl. No. 13/779,032.

*Primary Examiner* — David J Walczak
(74) *Attorney, Agent, or Firm* — Oliff PLC

(57) ABSTRACT

A brush, particularly a toothbrush, includes a head part with a cleaning structure that includes bristles, a hand part and a neck part, a cavity including at least one outlet opening for an active substance being located in the head or neck part. In one embodiment, the cavity incorporates an active substance element, containing the active substance in a carrier material and releases said substance in a controlled manner when it comes into contact with water. In another embodiment, the cavity is adapted to the shape of an active substance element through defined external contours. The volume of the cavity is preferably 1-2 times and no more than 4 times greater than the volume of the active substance element, ensuring that the latter is preferably surrounded by water during use. This allows the active substance to be effectively metered and ensures that the brush is easy to use.

26 Claims, 8 Drawing Sheets

Related U.S. Application Data continuation of application No. 14/458,710, filed on Aug. 13, 2014, now Pat. No. 9,538,837, which is a continuation of application No. 13/779,032, filed on Feb. 27, 2013, now Pat. No. 8,851,781, which is a division of application No. 13/341,212, filed on Dec. 30, 2011, now Pat. No. 8,408,833, which is a continuation of application No. 11/662,486, filed as application No. PCT/EP2005/009615 on Sep. 7, 2005, now Pat. No. 8,109,686.

(51) Int. Cl.
*A46B 3/00* (2006.01)
*A46D 3/00* (2006.01)

(52) U.S. Cl.
CPC ..... *A46B 11/0062* (2013.01); *A46B 15/0091* (2013.01); *A46D 3/00* (2013.01); *A46B 2200/1066* (2013.01)

(58) Field of Classification Search
CPC .... A46B 2200/1066; A46B 2200/1073; A46B 11/0001; A46B 11/0013; A46B 11/0068; A47L 13/12; A47L 23/04; A46D 3/00
See application file for complete search history.

(56) References Cited

U.S. PATENT DOCUMENTS

| | | | |
|---|---|---|---|
| 1,944,067 | A | 1/1934 | Collins |
| 1,947,720 | A | 2/1934 | Laub |
| 1,947,721 | A | 2/1934 | Laub |
| 1,995,374 | A | 3/1935 | Young |
| 2,127,794 | A | 8/1938 | Wastman |
| 2,260,100 | A | 10/1941 | Deitrich et al. |
| 2,262,982 | A | 11/1941 | Wolcott |
| 2,739,328 | A | 3/1956 | Bemier |
| 2,778,045 | A | 1/1957 | Bly et al. |
| 5,061,106 | A | 10/1991 | Kent |
| 5,066,155 | A | 11/1991 | English et al. |
| 5,181,531 | A | 1/1993 | Escoto et al. |
| 5,346,324 | A | 9/1994 | Kuo |
| 5,366,310 | A | 11/1994 | Armelles Flors |
| 5,392,482 | A | 2/1995 | Drulias et al. |
| 5,490,530 | A | 2/1996 | Snowden |
| 5,865,195 | A | 2/1999 | Carter |
| 5,909,977 | A | 6/1999 | Kuo |
| 6,602,013 | B2 | 8/2003 | Clark |
| 7,331,731 | B2 | 2/2008 | Hohlbein et al. |

FOREIGN PATENT DOCUMENTS

| | | | |
|---|---|---|---|
| EP | 1138223 | A1 | 10/2001 |
| EP | 1190643 | A1 | 3/2002 |
| FR | 2554331 | A1 | 5/1985 |
| FR | 2583625 | A1 | 12/1986 |
| FR | 2629989 | A1 | 10/1989 |
| FR | 2646068 | A1 | 10/1990 |
| GB | 491140 | A | 8/1938 |
| GB | 2263863 | A | 8/1993 |
| GB | 2323026 | A | 9/1998 |
| GB | 2343619 | A | 5/2000 |
| NL | 9400631 | A | 12/1995 |
| WO | 8801839 | A1 | 3/1988 |
| WO | 9303648 | A1 | 3/1993 |
| WO | 9713427 | A1 | 4/1997 |
| WO | 0053053 | A1 | 9/2000 |
| WO | 02058508 | A2 | 8/2002 |
| WO | 2004021914 | A2 | 3/2004 |

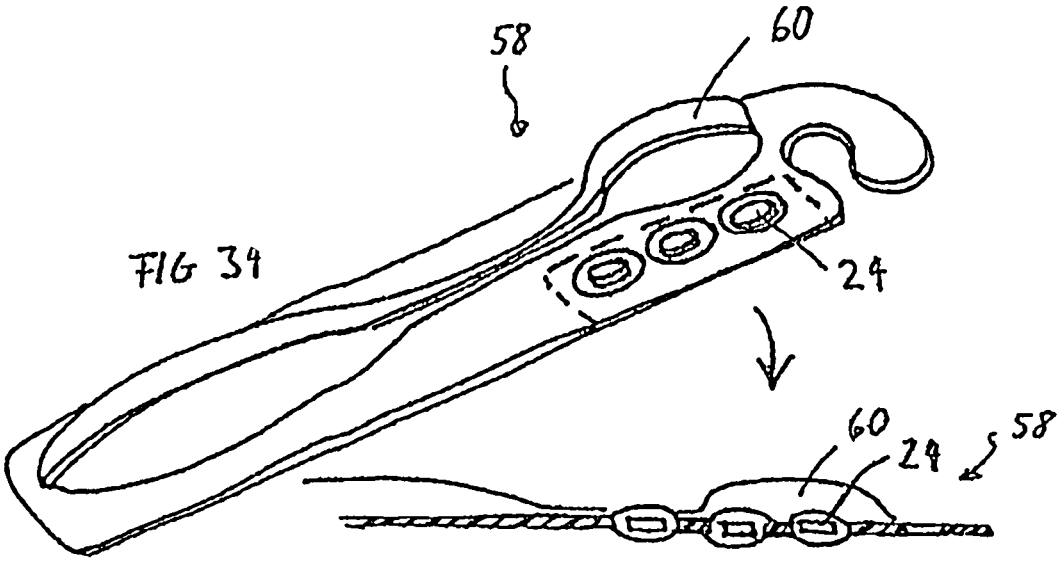
FIG 34
FIG 35
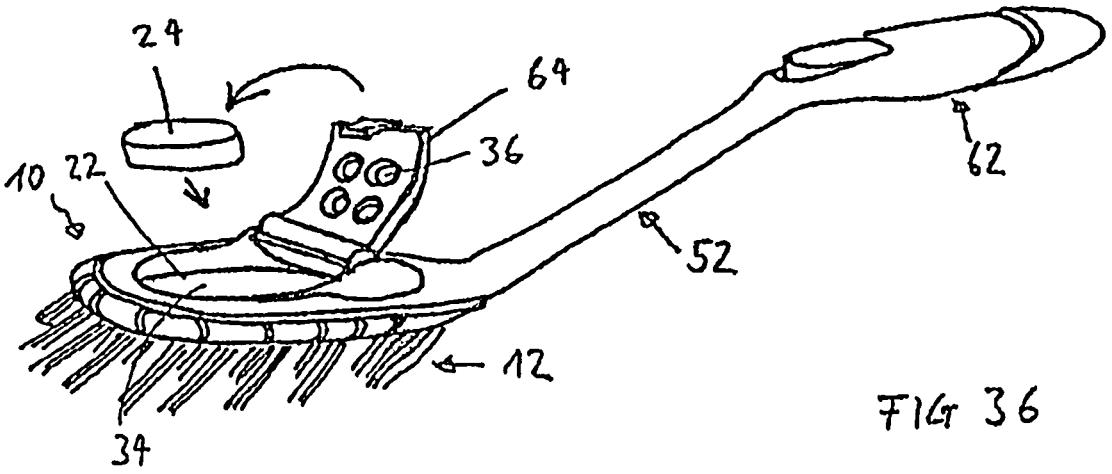
FIG 36

BRUSH, TOOTHBRUSH, AND ASSOCIATED PRODUCTION METHOD

This is a continuation application of U.S. application Ser. No. 15/371,578 filed Dec. 7, 2016, which in turn is a continuation application of U.S. application Ser. No. 14/458,710 filed Aug. 13, 2014, which in turn is a continuation application of U.S. application Ser. No. 13/779,032 filed Feb. 27, 2013, which in turn is a divisional application of U.S. application Ser. No. 13/341,212 filed Dec. 30, 2011, which in turn is a continuation application of U.S. application Ser. No. 11/662,486 filed Apr. 4, 2007, which in turn is a National Stage of PCT/EP2005/009615 filed Sep. 7, 2005, which claims priority to European Application No. 04022614.4 filed Sep. 22, 2004. In addition, U.S. patent Ser. Nos. 15/371,578, 14/458,710, 13/779,032, 13/341,212 and 11/662,486 are respectively issued as U.S. Pat. Nos. 10,390,606, 9,538,837, 8,851,781, 8,408,833 and 8,109,686. The disclosures of the prior applications are hereby incorporated by reference herein in their entirety.

The invention relates to a brush, in particular a toothbrush, and to an associated production method.

Disposable toothbrushes are known which, in various ways, already contain toothpaste. In U.S. Pat. Nos. 5,346,324 and 5,909,977, a very liquid is located in a reservoir in the handle area and is forced by a plunger into the head area, where it emerges through openings into the area of the bristles. Disadvantages of this are the difficult dosing of the toothpaste, the need to use very liquid toothpaste the unwieldy handle, the frequent drying-up and therefore blocking of the fluid channel, and the difficult to impossible refilling of the reservoir.

Toothbrushes are also known in which a predetermined amount of toothpaste is located in a cavity in the head area and is squeezed out of the head area by manual deformation before cleaning the teeth. In U.S. Pat. No. 1,947,720, deformation of the head area causes a slit-like and initially closed aperture to break open, such that the toothpaste can emerge. Repeated use by refilling is not possible, nor is exact dosing possible, Release of the toothpaste also requires application of considerable force. Similar examples in which toothpaste is squeezed out manually are disclosed in FR 2,583,625 or U.S. Pat. No. 5,865,195. In U.S. Pat. No. 5,490,530, the outlet openings can be closed again by a slide. The toothpaste is squeezed out by pressing a button which is arranged on the underside of the head part and which decreases the volume of the toothpaste reservoir. Exact dosing of the toothpaste is also difficult here. Refilling of the reservoir is impossible. In U.S. Pat. No. 5,366,310, the toothpaste is located in a sealed capsule which is pushed into the brush head. After the seal is removed, the toothpaste is released by squeezing it out manually. Although refilling is in principle possible in this case, exact dosing is still difficult.

In all the examples mentioned, the user has to act manually on the brush in order to release any toothpaste. Since a certain force is needed for this, and since a certain dexterity is required for the desired dosing, the known toothbrushes are not easy to handle for everyone.

In WO 2004/021914, a disposable toothbrush contains an encapsulated portion of liquid dentifrice in the area of the bristles. The capsule is broken open by contact with the teeth. The problem with this, in addition to the fact that it is limited to a single use, is that the dentifrice can emerge even when the toothbrush is not used properly. In addition, there is a certain risk of damage to the palate and gums at the non-defined rupture points of the capsule.

The invention is therefore based on the object of making available a brush, in particular a toothbrush, with an active substance, which brush or toothbrush is suitable for repeated use and/or for refilling of the active substance and permits simple handling and simple dosing of the active substance. Moreover, a method for producing such a brush is also to be made available.

Advantageous developments are set out in the dependent claims, the description and the drawings.

In a brush, in particular a toothbrush, with a cavity which is arranged in the head part or neck part and which has at least one outlet opening for an active substance, said cavity according to the invention contains an active substance element which is composed of a carrier material and of an active substance bound in the latter. The carrier material releases the active substance in a controlled manner upon contact with water. The carrier material is preferably solid, but can also be a high-viscosity paste. Preferably, it is to a large extent dimensionally stable when not in contact with water.

Alternatively, or in addition to this, the cavity is adapted to the shape of the active substance element with a defined external form. The volume of the cavity is greater, in particular 1-2 times greater, and not more than 4 times greater, than the volume of the active substance element. The active substance can also protrude from the head in order to form a sufficient contact surface for the release of active substances. This ensures that water washes sufficiently round the active substance element during use.

The release of the active substance takes place in a purely passive way, by means of water washing round the active substance element, and no manual action on the brush is necessary. The brush would therefore already release active substances if it were to be placed in water at temperatures of 15° Celsius or higher. The movement involved in cleaning the teeth can of course additionally assist the migration of the active substance through the improved circulation of liquid, but the aim is to ensure that the brush releases active substances in connection with water without mechanical actions. The dosing can be adapted and predetermined by suitable choice of the solubility or break-up of the active substance element, or its ability to release the active substance, and the size of the outlet openings, and the dosing does not therefore depend on the dexterity of the user.

In an advantageous development, the brush is flexible, at least in the area of the cavity, in such a way that, when the brush is used as intended, i.e. for cleaning the teeth, the cavity deforms in such a way that water is sucked into the cavity and forced out again. In contrast to the prior art in which a pasty composition is squeezed out by manual pressure before cleaning the teeth, the invention makes use of a pump/suction effect on the water, permitted by the flexibility of the cavity. In this way, the intake of water into the cavity and the washing-out of the active substance can be intensified without the user first having to manipulate the brush. The cavity is for this purpose preferably adapted to the shape of the active substance element, such that the latter is spaced apart at least partially from the inner wall and water washes round it during use. Advantageously, the cavity is at least partially enclosed by thin-wailed boundary elements with a wall thickness of less than 3 mm, preferably of less than 1.5 mm, made of elastomeric soft material, in order to generate said pump effect even upon the slightest contact.

In addition to the flexible cavity, it is also possible for the entire brush head to have flexible, movable partial areas, e.g. a flexible front part of the brush head. The flexible deflection of this partial area also influences the volume of the cavity and, once again, the above-described pump/suction effect is produced.

The flexibility of the brush head is preferably formed at the location where the cavity takes up the greatest proportion of the cross section of the brush head. This has the advantage that only a small proportion of the cross section of the head has to be made flexible. This can be done by targeted weakening of the material, for example a film hinge, lateral tunnel, etc., in the hard component, or by means of a combination of the hard and soft component. It is also possible for the flexible zone to be made completely from soft material.

The active substance element is preferably a solid body or a highly viscous and dimensionally stable paste, but it can also be formed by an encapsulated liquid, pasty or particulate substance with a water-soluble envelope. By suitable choice of the solubility or break-up of the active substance element or of its envelope, it is possible to achieve a dosing that is well defined and that may permit a uniform release of active substance throughout a teeth-cleaning procedure. In the case of a solid body or a highly viscous paste, multiple use of the same active substance element is possible if the latter is dimensioned, and its solubility or break-up chosen, such that it lasts for several typical cleaning procedures. Depending on their intended purpose, the active substances are released before, during or after the teeth-cleaning procedure. In this case, there is no danger of the openings drying up and clogging, because any residues can be easily washed away after use.

In another embodiment variant, the active substance element comprises a substantially dimensionally stable carrier from which the active substance is washed out, but which maintains its original shape. It preferably contains indicator by which it changes color or fades over the period of use or in line with the number of uses.

In an advantageous development of the invention, the active substance element can be refilled via a recloseable insertion opening. In this way, it is possible to complete the step from a simply designed disposable brush to a high-quality cleaning product.

The active substances perform the following tasks for example:

(a) antibacterial action within the brush head
(b) indication of the success of cleaning
(c) introduction of cleaning substances that are not contained in conventional cleaning agents
(d) introduction of cleaning agents that serve as a two-component system in combination with conventional cleaning agents
(e) bleaching.

The brush is composed of a head part with a cleaning structure, generally bristles, and with a neck part and a handle part. All the component elements can be made from at least one hard component and one or more soft components. Examples of hard components that can be used are polystyrene (PS), styrene-acrylo-nitrile (SAN), polyester (PET), polyethylene (PE), polymethylmethacrylate (PMMA), acryl-butadiene-styrene (ABS), etc., preferably polypropylene (PP). Examples of a soft component that can be used are an elastomeric material such as polyurethane (PUR) or polyethylene (PE), preferably a thermoplastic elastomer (TPE or TPU). In the brush head, hardnesses of below 70 Shore A are used, preferably of below 40 Shore A. The bristle region is preferably formed at least partially with conventional bristles, e.g. of polyamide (PA) or polyester (PBT) and, optionally, with elastomeric cleaning or massaging elements. The conventional bristles have, for example, a cylindrical geometry with a diameter of less than 0.25 mm, preferably of between 0.1 mm and 0.2 mm, and are gathered into bundles. The elastomeric massaging or cleaning elements usually have greater diameters, with the smallest dimensions in the cross section of 0.5 to 5 mm, preferably 0.5 to 2 mm. Cleaning elements, in particular bristles and/or pliable elements, are preferably arranged in direct proximity to the outlet openings, and their mechanical properties, e.g. dimensions, flexibility, material, are adapted to the action that is to be achieved with the active substance that is to be introduced. Examples in toothbrushes are:

(a) abrasive active substances with shorter bristles for surface cleaning (whitening effect),
(b) antibacterial active substances for deep cleaning with longer interdental bristles,
(c) skincare active substances in the area of the elastomeric massaging or cleaning elements for invigorating the gums, oral cavity or tongue,
(d) other combinations of active substances and corresponding bristles.

The cavity offers space for at least one active substance element. The cavity preferably offers additional space such that water can wash round the active substance element and, in this way, the active substance is able to exert its action by means of being partially or completely dissolved. To permit sufficient circulation of water in the cavity, provision is preferably made for the volume of the cavity to be designed not more than four times greater, particularly preferably one to two times greater, than the size (the volume in the original size) of the active substance element. In toothbrushes, the cavity has a volume of from 5 to 1500 $mm^3$, preferably 100 to 500 $m^3$.

The active substance element can be clamped laterally or vertically in the cavity. To ensure that water is able to circulate around it to the greatest possible extent, projections or other geometric elements are preferably formed for this purpose in the soft and/or hard component in the cavity. This ensures that, during the cleaning procedure, the active substance element cannot be struck back and forward within the cavity and cannot break apart too early. However, the active substance element can also protrude outward through recesses in the boundary of the cavity and can extend out of the brush head laterally or on the face supporting the bristles.

The cavity is preferably generally designed such that the active substance element is positioned in a stable manner in the cavity despite the continuous break-up. For this purpose, the cavity is provided with a flexible element which is made from soft material and which exerts a kind of spring action on the active substance element, for example by an outer wall of the cavity being curved outward upon insertion of the active substance element. The active substance element in the original size is fixed in the cavity with a certain pretensioning. Except for the above-mentioned projections, the inner shape of the cavity essentially follows the geometric shape of the active substance element, preferably with a predefined distance. This preferably results in a substantially spherical or ellipsoid geometry of the cavity, adapted to spherical or ellipsoid active substance elements. In an alternative embodiment variant, the cavity can be designed as a slit into which a plate-shaped or film-shaped active substance element can be inserted. In another embodiment variant, the active substance element can be inserted in a rod-shaped or cylindrical geometry into a correspondingly shaped cavity.

In a plan view of the cleaning structure, the cavity lies preferably inside the bristle region, if conventional bristles are present. This means that the cavity can be produced with a thin wall, but a sufficient number of bristles can still be anchored all round the cavity, with a certain anchoring depth required for technical reasons. Cleaning elements made from a soft component, which require less head volume and anchoring depth than conventional bristles, are preferably formed directly over the cavity. In addition, for secure anchoring, conventional bristles require the hard component. Since the cavity on the face of the brush head supporting the bristles is preferably delimited by a membrane of soft material, it is technically very difficult to anchor conventional bristles in this area.

The cavity is delimited by a wall of hard and/or soft component, but preferably at least in some areas also by soft component, since the aforementioned flexibility can easily be achieved in this way.

It is advantageous, as regards the anchoring of the bristles, if the cavity is positioned in an area which adjoins the brush head, for example in the brush neck or in the transition between brush neck and brush head, and which comes into contact with water. This design has the advantage that the cavity does not have to be taken into consideration in anchoring the bristles within the brush head. The fact that the active substance does not emerge where it generally exerts the optimum effect, that is to say in the head area, is taken into account.

The cavity comprises at least one outlet opening for the entry of water, for the emergence of the active substance dissolved in the water, and for washing out the cavity under a tap after use. In variants with a refill option, at least one insertion opening for insertion of the active substance element by the user is additionally provided. The insertion opening, in the opened state, is larger than an outlet opening. The insertion opening is preferably located on the rear face of the brush head, and the outlet opening on the front face of the brush head. Alternative embodiment variants have the insertion opening on the side of the brush head. Alternatively or in addition, the outlet openings can be placed on the side and/or rear face of the brush head.

The insertion opening can preferably be reclosed. However, it can also serve as an outlet opening and must not completely seal off the cavity. The insertion opening can be formed by means of a cover or closure piece which is either removable or integrated into the head, for example by means of a film hinge injection-molded directly onto the head. Particularly preferably, the recloseable element is a membrane made from soft material and having a suitable opening which, for example, comprises one or more intersecting slits and corresponds to the size of the active substance element. The membrane can at the same time constitute a flexible wall of the cavity and/or serve as a support for cleaning/massaging elements. As an alternative to slits, other geometric elements can be provided which permit insertion of the active substance element and as far as possible prevent its escape, for example an expandable hole formed in the membrane and smaller than the active substance element.

In the case of a membrane, the latter has a thickness of less than 3 mm, preferably a thickness of 0.7-1.5 mm. Preferably, 2 to 6 slits are used as the insertion opening. The length of the slits is 3-15 mm, preferably about 6-10 mm, for toothbrushes.

The insertion opening can have a safety device which prevents the active substance element from falling out during use, or at least makes this difficult. For example, the membrane is formed with slits or a funnel in such a way that the active substance is inserted with little pressure (e.g. 10 to 300 g), but falling out requires more pressure, by virtue, for example, of a funnel-shaped geometry in the area of the opening. It is less preferable, but still possible, to provide additional closure elements or securing elements.

The insertion opening can still be closed at the time of the first use (tamper-evident safety means or seal). The first time the active substance element is inserted, the tamper evident safety means can be broken by the user, for example by severing thin residual connections within the prefabricated slits.

The outlet openings permit a continuous but limited emergence of the active substance dissolved in water. The number of openings and their size (total surface area of the outlet opening) and the water-solubility of the active substance element or of the carrier material determine the actual emergence of the active substance dissolved or dispersed in water. Since the water-solubility of the active substance tends to represent a resultant parameter, the outlet openings (number and size) are adapted to the water-solubility of the active substance, in order to determine the range of the active substance during use. In this way, the dissolving of the active substance element can also serve as a time indicator for the (total) cleaning period that has hitherto elapsed.

An individual outlet opening is preferably not less than a minimum surface area of 0.05 $mm^2$. This is because smaller openings can easily soil and thus impair the exchange of liquid. In addition, it is advantageous if the user can see through the outlet openings to assess the amount of active substance element still remaining in the cavity and can decide whether the active substance should be topped up. For these reasons, surface areas of 0.05-100 $mm^2$, preferably 1-20 $mm^2$, are preferably used for the outlet openings. This ensures precise dosing and prevents the active substance or fragments of the active substance element from being able to leave the cavity in an uncontrolled manner.

The individual outlet openings on a brush head can have different sizes (surface areas) in order to weight the released amount and the site of release. Preferably, individual groups of outlet openings are arranged at specific locations on the brush head. In this way, the release of the active substances at different sites of the bristle region can be controlled in terms of quantity and location. As has been mentioned above, there is preferably an interplay between the active substance and the active bristles specifically provided in combination with it. One to five groups (clusters) of outlet openings are preferably formed. These groups of outlet openings can also be positioned on the brush head asymmetrically with respect to the longitudinal axis. The different groups of outlet are preferably produced from the same material in one operating step. Particularly if the outlet openings are formed in the elastomeric material, this is done from one injection point for all groups, i.e. these groups are materially connected to one another. The outlet openings can be designed with geometric elements that increase the surface area in proximity to the outlet opening, in order to keep the active substance as much as possible in the area of the brush head. For example, a substantially funnel-shaped geometry can be used, or a geometry at least opening toward the outside. This also makes it easy to clean the cavity under a tap after use. Additional cleaning and massaging elements in the area of the outlet openings have the same advantage. For the same reason, however, as an alternative design element, sponge-like or perforated, soft elements can be positioned in the area of the outlet openings and likewise contribute to better retention of the active substance.

The outlet openings can be formed in the hard material and/or in the soft material of the brush head. However, they are preferably integrated into the above-described membrane made from soft material. In this case, the latter preferably has a thickness of less than 3 mm, preferably of 0.7-1.5 mm.

As has been described above, the cavity is preferably delimited by a membrane or membranes of soft material. Said membrane or membranes are flexible in order to adapt to the surrounding environment (gums, teeth, oral cavity, etc.) during use, and in order to exert a certain pump/suction effect on the cavity under the pressure exerted on the membrane by the cleaning procedure. These effects can be intensified by a curved shape of the membrane. Together with the outlet openings, the membrane can form a kind of expandable mesh structure. As has been described above, this mesh structure can have minimal outlet openings with a surface area of at least 0.05 $mm^2$. Of course, mesh structures can be arranged on all sides of the brush head. To increase the surface area and thus maximize the cavity, they preferably have a convex U-shaped or cup-shaped outer geometry. The crosspieces of the mesh have a diameter of 0.1-2 mm, preferably of 0.2-0.5 mm, and are made from soft material (e.g. TPS, or PE).

Said membrane or membranes with the openings preferably form recognizably separate geometric elements within the brush head which are visible to the user and which in particular are also distinguished in color from the rest of the brush head. The user can therefore quickly see where the active substances emerge from the brush head. In different embodiment variants, the following geometric elements for the membranes can be used:

(a) The membrane or membranes with the openings are preferably designed with a curved/ellipsoid/balloon shape. The membrane with the outlet openings can have a mesh-like structure or simply just a few holes. The curved membrane or membranes are preferably positioned on the front face and rear face of the brush head, but can also be positioned on the sides.
(b) The membranes with the openings form a kind of flexible concertina or bellows structure on the side or rear face of the brush head. The peaks of the concertina structure serve as cleaning and massaging elements.
(c) The membranes with the openings form a kind of gill structure on the side of the brush head. The outlet openings are formed by means of slits in this structure.
(d) The membranes with the openings form a kind of nipple/knob structure preferably on the side of the brush head or rear face of the brush head. The outlet openings are formed in a funnel shape inside the elevations.

Moreover, cleaning and massaging elements made from soft material are preferably formed integrally on the flexible membranes delimiting the cavity. This partial aspect of the invention, that of designing a part of the brush head with a flexible membrane and of designing the latter with cleaning and/or massaging elements made from soft material, can advantageously also be used for brushes that do not have a cavity for active substances, but for example only have an empty cavity or no cavity at all. The membrane and the cleaning and/or massaging elements are preferably Produced in one operating step, particularly by the injection-molding technique. This permits production of a brush with a particular elastic suspension of the cleaning/massaging structure. Unless specifically relating to the cavity, the following preferred designs also apply to brushes without a cavity, but with a membrane provided with a cleaning/massaging structure.

In the toothbrushes according to the invention, the fact that cleaning and/or massaging elements made from soft material are formed integrally on a flexible membrane has the following advantages:

(a) The surface area in the region of the outlet openings is further increased, such that the active substances are held as long as possible on the brush head (retention) and permit a uniform release during the cleaning procedure.
(b) it is difficult, from the production point of view, to anchor conventional bristles in a thin membrane. The Pliable elements increase the cleaning action, and thus the efficiency of the brush head, on the face of the brush head supporting the bristles.
(c) The flexibility of the membranes additionally increases the cleaning action of the cleaning elements positioned on them, since the flexibly mounted cleaning and massaging elements can better adapt to the irregular surface of the dentition, of the oral cavity, of the tongue or of the gums.
(d) The cavity, which is delimited by flexible membranes, is easier to clean (e.g. with the fingers or with a cotton bud) since the membrane can be bent into a suitable position for cleaning.

The cleaning or massaging elements in the area of the outlet openings preferably have a bristle-shaped, lobe-shaped, lamella-shaped or nipple-shaped geometry. These elements are preferably formed conically and are preferably formed from the same material as the membrane in the same operating step. The following structures are possible, for example (a) a bristle-like structure from the node points of a mesh-like membrane,
(b) massage lobes, lamellas or knobs on the side of the brush head or the rear face of the brush head, for massaging the gums, oral cavity or tongue.

From the production point of view, it is preferable if the cleaning and/or massaging elements located in the area of the outlet openings are oriented parallel to the de-molding direction of the brush head. It is more complicated in manufacturing terms, but more effective during use, to provide cleaning or massaging elements that are oriented at a defined angle, preferably substantially at right angles, to the curved membrane surface.

The cleaning or massaging elements located in the area of the outlet openings are preferably less long than the conventional bristles in their proximity, with the result that, during use, a kind of reservoir for the active substance dissolved in water can form in the end area of the cleaning or massaging elements.

In addition to the outlet openings of the membranes, the cleaning and massaging elements themselves can also have outlet openings, which is the case, for example, in straw-shaped bristles, lamellas and nipples with holes. These have the advantage of being able to bring the active substance directly to the site of use. The active substance can in this case cover a relatively long distance by means of a capillary action.

In another possible embodiment variant, the membrane itself can release or allow the passage of active substances in the submicroscopic range, for example as a result of microporosity or semi-permeability.

The active substance element is preferably a solid body which at least partially dissolves in water during use. The active substance element in the form of a solid body is shaped as a tablet, pill, rod-shaped element, plate or film to match the cavity. Alternatively, and less preferably, it is possible to use a paste or ductile composition with a dynamic viscosity higher than that of conventional and commercially available pastes (toothpastes). A spatially defined structure can thus be produced, and the active substance can be held as long as possible in the cavity. After its introduction into the cavity, the paste can harden, in order to release the active substance in diverse applications.

The active substance can be easily portioned by the user. The solid body is already pre-portioned in the package in which it is sold. The paste can be easily portioned by the consumer, by virtue of the predefined volume of the cavity.

The active substances can be used together with conventional cleaning agents or independently of these. The brush can generally also be used without active substances, and with conventional cleaning agents.

The active substance element can have several phases with different active substances which can be released in a time sequence according to their structure. The following alternatives are possible:

(a) solid body composed of several shells or layers (break-up of one shell after another);

(b) solid body with a liquid or particulate core, which is released after break-up of the shell.

A distinction can be made between the following types of active substances which, together with a suitable carrier material, form the active substance element:

(a) Toothpaste-like action, which removes the need for a conventional toothpaste. The following ingredients are possible: sorbitol, flavoring agents, hydrated silica, sodium lauryl sulfate, sodium monofluorophosphate, creatine, zinc sulfate, triclosar, glycerin, sodium saccharin, propylene glycol, disodium phosphate, alumina, trisodium phosphate, sodium fluoride, betaine, titanium dioxide, cellulose gum, cetrasodium pyrophosphate, etc.

(b) Antibacterial action for occasional cleaning of the brush head in a beaker before or after cleaning the teeth. The following ingredients are possible: sodium bicarbonate, citric acid, phosphoric acid, sodium carbonate, potassium carbonate, sodium perborate, sodium hexane taphosphate, sodium benzoate, sodium stearate, etc.

(c) Indication of the success of cleaning by staining of the plaque on the surface of the teeth, by means of staining of the plaque residues. The following ingredients are possible: glucose, maltodextrin, magnesium stearate, flavoring agent, saccharin, microcrystalline cellulose, etc.

(d) Auxiliary active substances which do not occur in conventional pastes and which complement or intensify the action of said pastes. Ingredients from (a-c).

(e) Ingredients for bleaching, for example ingredients containing hydrogen peroxide.

(f) Two-component system composed of active substances and of specially developed toothpaste. When they meet, a chemical or physical reaction takes place. This variant is provided especially for active substances that cannot be integrated in a paste, because they would react directly with one another.

Examples of carrier materials that can be used are biodegradable substances based on starch or plastics that do not chemically react with the active substances. A preferred carrier material is Polyox from Dow Chemicals, a water-soluble synthetic resin based on polyethylene oxide polymers, which is suitable for formation of a matrix or carrier for an active substance and which, because of its thermoplastic properties, can also be processed in a variety of ways, for example cast, injected or extruded.

In principle, both single use and also multiple use of an active substance element are possible. In single use, one application of the brush uses up one active substance element. The active substance element can be inserted again before each application or can also just be used occasionally. In the case of multiple use, one application of the brush uses up only some of the active substance element. The user knows when the active substance is used up and can then refill the brush by means of a new active substance element. It will be appreciated that the concentration and amount of the active substance will be much lower for single use than for multiple use. In single use, the concentration corresponds approximately to the concentration of the active substances of conventional Pastes. In multiple use, the corresponding concentration is increased by several times. In addition to the concentration, the range/period of use of the active substance element is also influenced by the water-solubility and water circulation/openings.

In single use and multiple use, the system, cavity, openings and water solubility of the active substance element can be set such that a certain period of use can be indicated to the user (time indicator). For example, in single use, the properties are chosen such that the active substance is used up after 3 minutes' cleaning time. In multiple use, the active substance is, for example, used up after a typical period of use of 3 months, by which it is possible to indicate that the entire brush should be replaced because of wear. An inscription (for example "Change") can even be concealed under or in the active substance element and becomes exposed after the active substance has been used up, such that it becomes visible to the user and draws the user's attention to the imminent need to replace the active substance element or to the recommended replacement of the brush.

To increase the surface area that water washes around, the active substance element can be provided with additional recesses and concave or convex elements on the surface.

The color of the active substance element is preferably chosen such that it is clearly distinguished from the brush head and the user can easily assess how much active substance has been used up.

The solubility or break-up of the active substance and of the carrier material depends on the water temperature used. The user can control the release of the amount of active substance by regulating the water temperature. With a temperature increase from 10° C. to 40° C., the amount of active substance released increases significantly.

In an advantageous development, the active substance is bound into an effervescent tablet or into a paste with an effervescent action as carrier material. This additional function allows the user to ascertain, during use, whether the active substance is already used up or is still present in the cavity, without removing the brush from the mouth.

The brush is preferably packaged in such a way that the pack clearly shows the consumer the brush and the active substance element. The active substance element is preferably positioned next to the brush head. The active substance element is preferably provided in a part of the pack independent of the opening for the brush. In this way, the active substance element remains hygienically closed until the intended portion is opened. A first active substance element is preferably already positioned in the cavity of the brush head inside the retail pack. The brush head is positioned in the pack in such a way that the insertion openings and outlet openings can be shown. This can be done in particular using a so-called double blister pack, which allows the user to see both sides of the brush head. In addition to the purchase of whole brushes with active substance, it is also possible for just the active substance element to be provided as a refill pack. As an alternative design variant, the active substance in a suitable carrier material can also be provided in a dispenser for portioned delivery. As an alternative to inserting the active substance element by hand, the brush head in this design variant can be introduced into the dispenser, and the active substance can then be dispensed mechanically through the insertion opening and into the cavity.

The cavity can be formed by the following injection-molding techniques:

(a) Variants with a one-piece brush head:

(a1) Forming the cavity by means of mold cores/slides from the head side supporting the bristles and/or from the rear face of the brush head. In addition, and optionally, at least partial forced de-molding of a deliberately undercut mold core for formation of a membrane that delimits the cavity. To simplify its forced de-molding, the membrane can be inflated by means of air pressure through the mold core, thereby making damage-free de-molding easier. Alternatively, the membrane can be deliberately slit in the area of the insertion opening (e.g. mechanically in the mold tool by means of slides/knives) which likewise promotes the de-molding of the undercut mold core. Injection of optional cleaning and massaging elements during production of the membrane.

(a2) Like (a1), but forming of a cavity by means of mold cores/lateral slides for formation of a tunnel extending transversely through the brush head. Analogously, the above-described forced de-molding can likewise be used for formation of slits in the insertion opening.

(a3) The cavity can be formed by means of over-injecting of the active substance element. In this case, the active substance element is fixed with a form-fit and force-fit on the hard component in the head area and, in a further operating step, is at least partially over-injected preferably with the soft component. In this alternative production variant, the active substance element seals the outlet openings in the hard component off from the soft component. A disadvantage of this variant is that the active substance and the carrier material have to withstand the high temperatures and injection pressures of the soft component, and water can only partially wash round them, because the soft component bears directly on the active substance element in the over-injected areas.

(a4) As an alternative production variant, particularly in solutions in which the active substance element is intended for multiple use, the active substance element can be injected by means of injection molding into the cavity or into a corresponding recess. For this purpose, the active substances are preferably bound into a plastic matrix as carrier material, which connects to the hard component of the brush head in a subsequent injection-molding process. The brush head, with the active substance injected on, can thus be produced in a multi-component injection-molding technique. In one variant of the invention, the carrier material is water-soluble and can also be completely or partially dissolved during use. To produce the matrix from the carrier material, use is made, for example, of substances based on starch or other physiologically safe and degradable substances that can be processed in injection-molding techniques, for example cornstarch or Polyox®. Alternatively, use is made of a plastic matrix which reacts to water, and in so doing releases active substances, and which does not degrade but instead substantially maintains its original geometry. This includes the abovementioned hard or soft materials, to which the active substance is admixed as an additive before or during the injection-molding process. In this variant, it is advantageous if the active substance element changes its color or at least fades as the active substance is released, so as to show the user the ageing of the product. A material is preferably used which connects to the hard component or the soft component of the brush head. Since polypropylene PP is a common hard material for producing toothbrushes, a carrier material is preferably used which connects to PP. When using another hard material for the brush head, a carrier material, is used which connects to this hard material during the injection-molding process. Since suitable carrier materials can be relatively expensive compared to the other materials used, it is proposed that the active substance element be injected on in the brush head or in the brush neck. The injection point is preferably situated on the rear face of the brush head. In this embodiment variant, the active substance element is brought by injection molding into a tablet shape or pill shape or into another above-described shape. The active substance element is preferably arranged in a kind of sandwiched position between two materials used in the head, for example a hard material and a soft material, or two possibly identical hard materials. In this case, the hard material is advantageously first injected, then the active substance element is formed or injected, and then the active substance element is at least partially covered with the soft or hard material. Alternatively, the carrier material can also be a component part of the bristles or of any elastomeric cleaning and massaging elements, or the latter can be coated with it. Of course, different active substance elements with different active substances can also be formed on or in the toothbrush head at different locations. A different color is then advantageously used for the different elements. With the production of the active substance element by means of injection molding, water can only partially wash round the active substance element, but optimal undercuts can be formed for anchoring the active substance element.

(b) Variants with a multi-piece brush head:

(b1) Conventional plugging or in-mold tufting (IMT) and cover: Injection molding of the toothbrush including the half of the brush head with the bristles, forming the outlet openings on the bristle side and forming any cleaning elements from soft component—anchoring the conventional bristles in the brush head—injection-molding the rear half of the brush head (cover) including openings—releasable connection (snap-fit, sliding fit, locking fit, etc.) or non-releasable connection (adhesive bonding, welding, positive locking, etc.) of the cover to the toothbrush.

(b2) Provision of bristles by means of anchor-free tufting (AFT): Injection molding of the toothbrush including the rear half of the brush head and forming of the openings on the rear face of the brush head—injection molding of the half with the bristles (bristle plate) including openings and forming of any cleaning elements from soft material—anchoring the conventional bristles in the bristle plate—releasable connection (snap-fit, sliding fit, locking fit, etc.) or non-releasable connection (adhesive bonding, welding, positive locking, etc.) of the bristle plate to the toothbrush.

(b3) The bristles are applied to a separate head plate; the cavity is provided with the latter and with another preferably recloseable cover (less preferred variant, since in three parts).

For all the variants discussed, it is possible for the active substance and the carrier material to be introduced into the brush head in a different state of aggregation than in later use. The active substance can, for example, be cast or injected into the cavity in liquid form (for example by heating or with addition of a solvent). After hardening, the active substance element is obtained which, during use with water, releases the corresponding active substances. The active substance element is preferably introduced into the cavity before the application of the cleaning elements, such as bristles, etc.

Any cleaning and massaging elements can be injected onto the membrane before or after the insertion of the conventional bristles.

The slits for the insertion opening can be produced by the following methods:

(a) Formation of the segments and slits in the separate state by means of injection molding.

(b) Formation of a thin material bridge within the slits as a tamper-evident safety means which can be severed by the user at the time of the first use.

(c) Formation of the membrane in the closed state. Creation of the slits by means of a mechanical method (e.g. cutting, punching, etc.) at a later stage (for example in the injection-molding tool, during assembly of the brush head, or during the process of fitting the bristles).

The injection points for the membranes, and for any cleaning or massaging elements placed on the latter, are as far as possible to be chosen inside the head or in the neck area of the brush. Areas of soft material in the handle of the toothbrush can be produced in the same operating step and with the same material.

The cleaning or massaging elements arranged in the area of the membranes are preferably produced with the same material and in the same operating step with the membrane. By choosing a soft component with a Shore A hardness of less than 70, preferably less, than 40, a compromise can be found between the functionality of the membrane ((a) flexibility: pump effect, cleaning support, introduction of the active substance, (b) adherence to the hard material, etc.)) and stiffness of the cleaning or massaging elements (cleaning action, massaging action). The membranes made from soft material are preferably bound to the hard component of the brush head in the multi-component injection molding technique. To ensure optimal adherence of the membrane to the hard component, care must be taken to ensure that the membrane is not injected edge to edge onto the hard component, and that a bevel/recess is instead provided in the hard component to increase the common surface area between hard component and soft component. For this purpose, a geometric element of 0.1-2 mm depth/length is formed preferably over most of the join of the membrane to the hard component, in order to permit better binding of the membrane.

The first insertion of the active substance element into the brush head can be done by the consumer at the first time of use, or it can be done during the production of the brush. With a two-part brush head, this can be done especially by means of AFT. In the AFT method, the active substance element is positioned in the toothbrush head before the bristled AFT plate is welded non-releasably to the handle of the toothbrush. The AFT method is generally recommended for positioning an additional structural part or element between the bristled AFT plate and the handle of the toothbrush.

Illustrative embodiments of the invention are described below and are shown purely schematically in the drawings, in which:

FIGS. 34, 35 show an example of a self-explanatory package for a toothbrush according to the invention;

FIG. 36 shows a household brush according to the invention.

Figure 1:
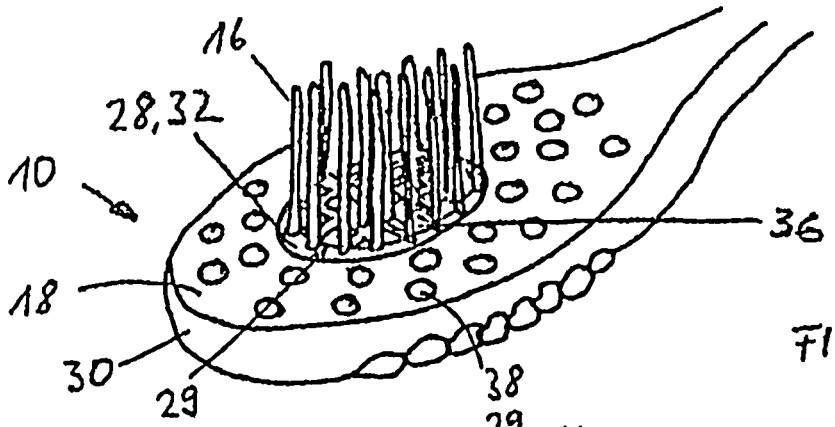
FIGS. 1-4 show different views of a head part of a toothbrush.
Figure 2:
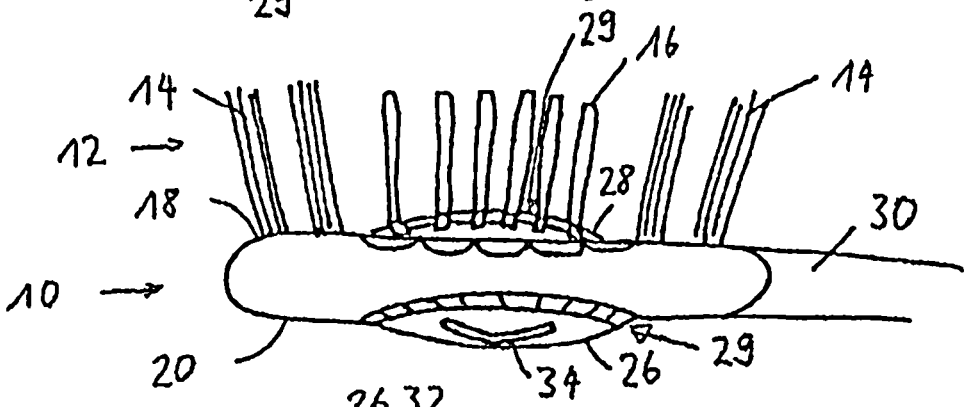
Figure 3:
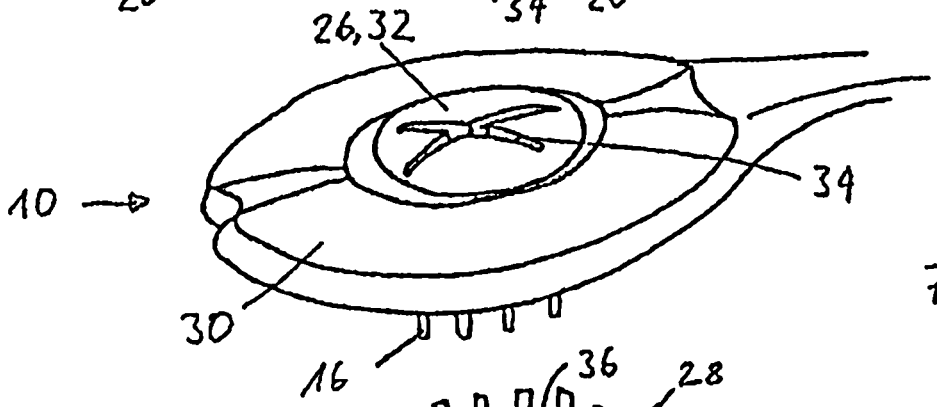
Figure 4:
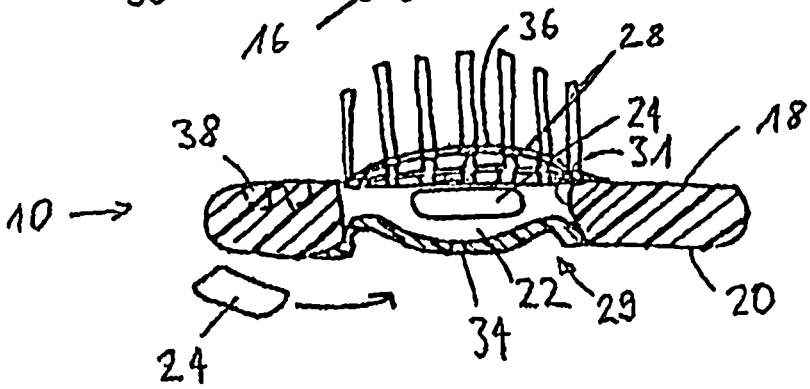

In the drawings, elements with the same functions are in each case provided with the same reference numbers, FIGS. 1-4 show different views of a head area 10 of a toothbrush according to the invention. A cleaning structure 12 composed of conventional bristles 14, gathered in bundles, and of pliable cleaning elements 16 is applied to the front face 18. Instead of the conventional bristles 14, in some cases only the anchoring areas 38 of the bristle bundles are indicated. The head area 10 is made from a hard component 30 which is solid (see also FIGS. 5-7) and in which in particular the conventional bristles 14 are anchored with a certain anchoring depth. Located within the hard component 30 there is an aperture 31 which, in a plan view of the front face 18, has a circular or elliptic shape and which is covered front and back by in each case an outwardly curved flexible wall in the form of an elastic membrane 28, 26 made of soft material 32. In this way, a cavity 22 is formed within the head area 10. The pliable structure 16 is anchored in the membrane 28 on the front face. The membrane and the pliable structure are preferably made together, in one production step, from the same material and starting from the same injection point. The membrane 26 on the rear face 20 has two intersecting slits which serve as a recloseable insertion opening 34 for an active substance element 24. As is shown in the sectional drawings in FIGS. 5-7, the membrane 28 on the front face has outlet openings 36 through which water can pass into the cavity 22 and can emerge again, this time enriched with active substance. The wall area of the cavity 22 is made from soft material 32 and forms a flexible zone 29. Under the pressure exerted when cleaning the teeth, the toothbrush deforms in this zone 29 in such a way that water is sucked into the cavity 22 and forced back out again.

Instead of a soft material, the membranes 26, 28 can also be produced from a hard component with suitably small wall thickness in order to achieve the necessary flexibility. However, the use of a soft component has advantages insofar as the anchoring of cleaning elements in a thin layer of hard material is problematic from the production point of view, whereas the simultaneous injection of pliable elements onto a soft membrane does not cause problems. Alternatively, a combination of hard and soft materials can also form the membrane. In this case, the flexible elements of the membrane and cleaning elements are made from soft material. The hard component only forms structuring and stabilizing elements of the membrane, or it is used only as a material connection required for production reasons.

Figure 5:
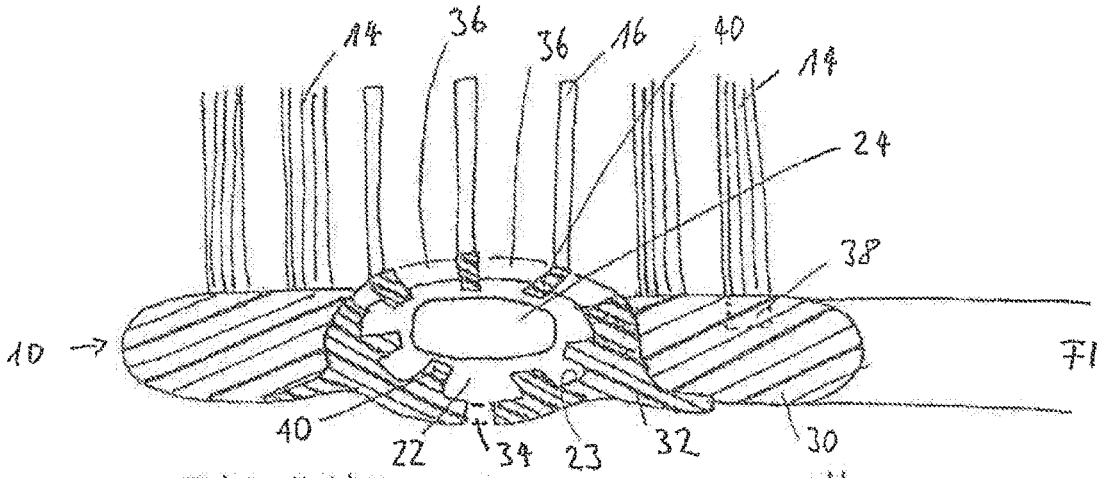
FIGS. 5-7 show different possibilities for forming the cavity in a toothbrush according to FIGS. 1-4.
Figure 6:
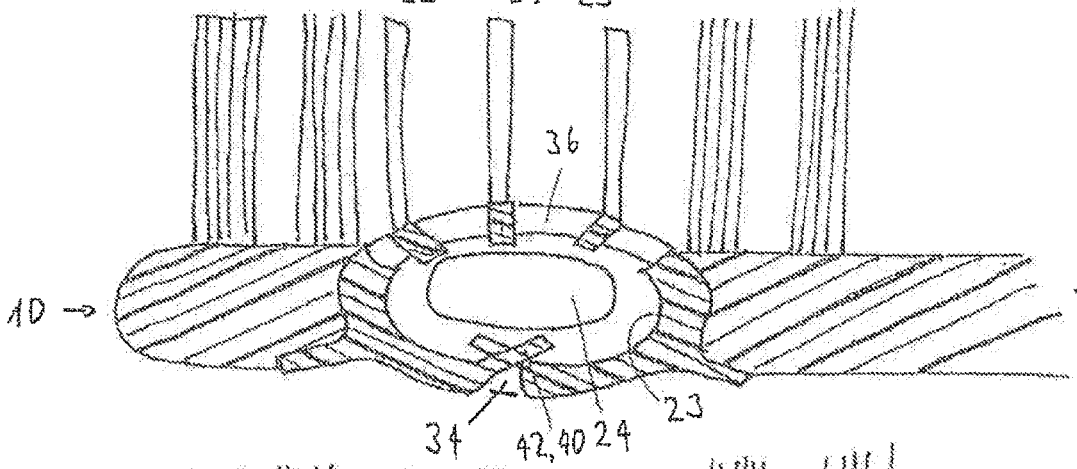
Figure 7:
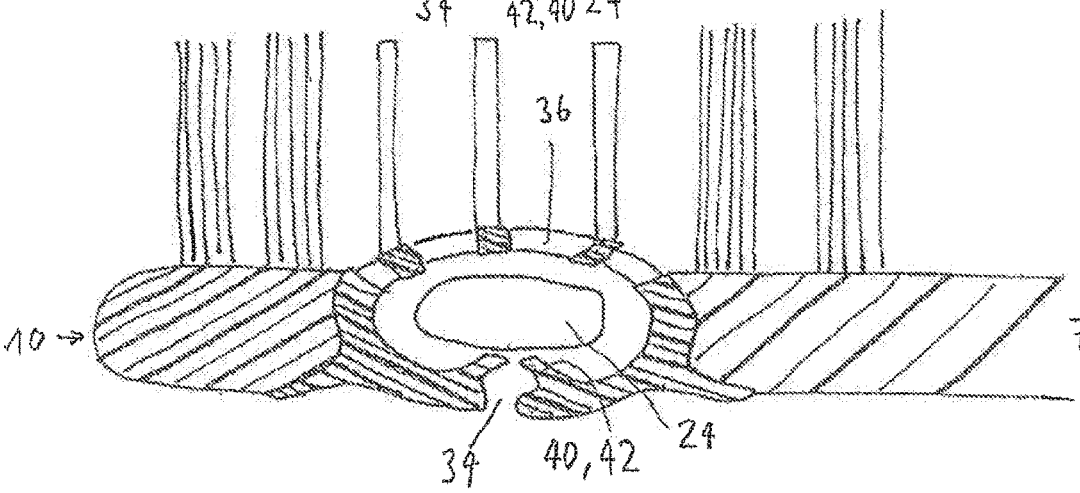

As is shown in FIGS. 4-7, the cavity 22 is adapted to the shape of an active substance element 24 in such a way that the latter is at least partially spaced apart from the inner wall 23 of the cavity 22. To permit secure holding of the active substance element 24, projections or edges 40 are formed that extend inward from the flexible membranes 26, 28 (FIGS. 5-7). The flexibility of the membranes 26, 28 means that the active substance element 24 is well positioned, even as it continues to break up.

In the examples from FIGS. 6 and 7, an insertion opening 34, provided with intersecting and mutually inclined closure flaps 42, additionally ensures that the active substance element 24 does not emerge again from the insertion opening under the effect of pressure when cleaning the teeth. The closure flaps 42 also serve as the abovementioned projections 40.

In the examples according to FIGS. 1-7, the outlet openings 36 are in each case located between the pliable cleaning elements 16 in the membrane 28 on the front face. The membrane surface thus has a perforated structure like a mesh.

Figure 8:
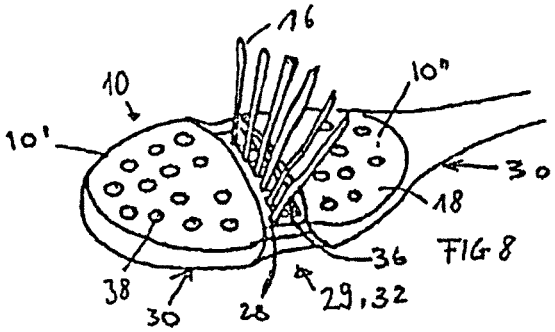
FIGS. 8, 9 show different views of a head part of a toothbrush with a flexible bend zone.
Figure 9:
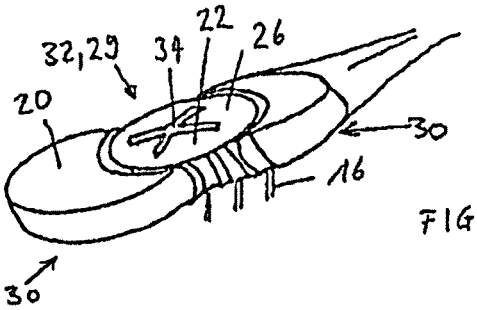

FIGS. 8 and 9 show another example of a toothbrush composed of hard and soft components 30, 32. Here, the soft component 32 forms a flexible zone 29 which interconnects the two otherwise separate parts 10', 10" of the brush head 10 made from hard component 30. In contrast to the above examples, the whole front part 10' of the brush head can be deflected relative to the rear part 10" of the brush head. As in the above examples, the cavity 22 is delimited on the front and rear faces, and also on the side, by thin material layers (membranes 26, 28) made from soft component 32, and, in the longitudinal direction, it is delimited by the hard component 30. This configuration provides particular flexibility of the brush head 10 and an increased pump/suction effect in the cavity 22. Alternatively, a connection piece made from hard component 30 can also be guided through the inside of the soft component 32, which allows the two parts 10', 10" of the brush head to be produced from hard component 30 in one operating step. This connection piece is preferably made very thin in order to ensure that the flexibility is not negatively affected. As in the above examples, it is mainly conventional bristles 14 that are anchored in the hard component 30, whereas the soft component 32 is provided with pliable cleaning elements 16. The insertion opening 34 is designed as intersecting slits, as in FIGS. 1-7.

Figure 10:
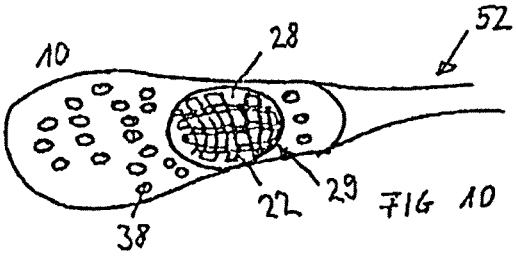
FIGS. 10, 11 show different views of a head part of a toothbrush with a flexible zone which is circular in a plan view.
Figure 11:
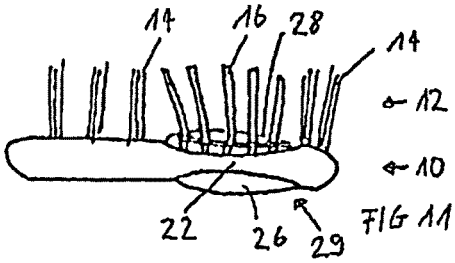

FIGS. 10 and 11 show an example which largely corresponds to FIGS. 1-7 and in which the flexible zone 29 with the cavity 22 is not located centrally within the bristle region, but is instead located more toward the neck area 52. This has the advantage that the most extensively loaded zone in the front part of the brush head can be formed from conventional bristles.

Figure 12:
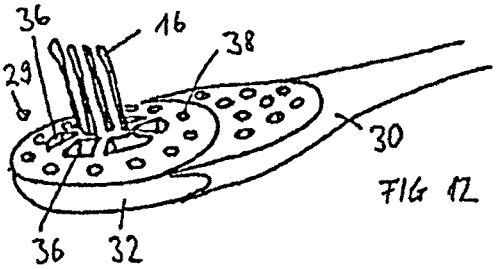
FIGS. 12, 13 show different views of a head part of a toothbrush with a flexible zone at the tip of the brush head.
Figure 13:
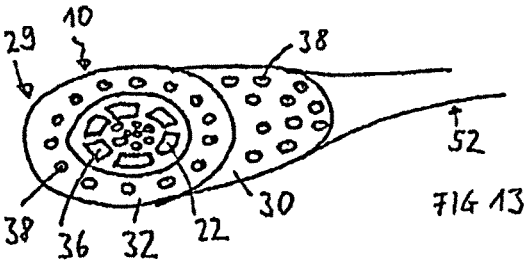

In FIGS. 12 and 13, the flexible zone 29 formed from soft material 32 occupies the entire tip of the brush and has, in plan view, a substantially circular shape. In a concentric arrangement, it here supports, from the inside outward, pliable cleaning elements 16, outlet openings 36 and conventional bristles 14 (or their anchoring areas). In the direction of the neck area 52, it is adjoined by a region of conventional bristles that is embedded in the hard component 30. The outlet openings 36 are large enough to allow the cavity 22 lying behind to be seen into.

Figure 14:
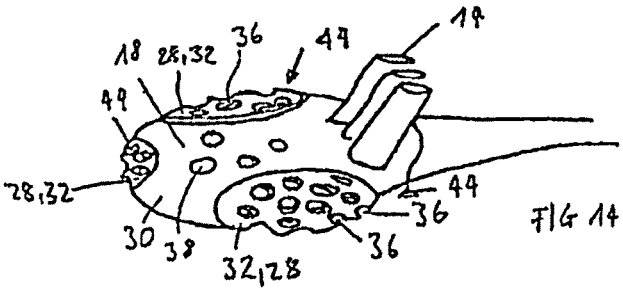
FIGS. 14, 15 show different views of a head part of a toothbrush with several clusters of outlet openings.
Figure 15:
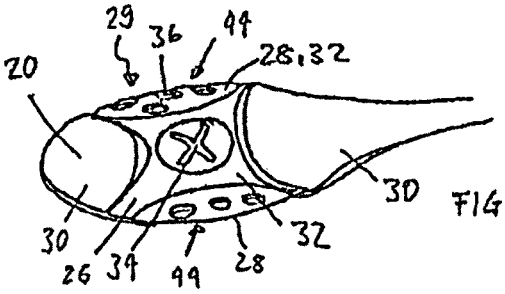

In the example from FIGS. 14 and 15, although the part of the brush head made from the hard component 30 is designed in one piece, it does have apertures, with the result that a continuous flexible zone 29 on the rear face 20 is formed with three areas (clusters) 44 of outlet openings 36. These are located at the tip and on the sides of the head area 10, in each case in an outwardly curved flexible wall/membrane 28, preferably made of soft material 32. The remaining area of the head part 10 is provided with conventional bristles 14 on the front face 18. On the rear face, there is once again an insertion opening 34 formed by intersecting slits, as in FIGS. 5-7.

Figure 16:
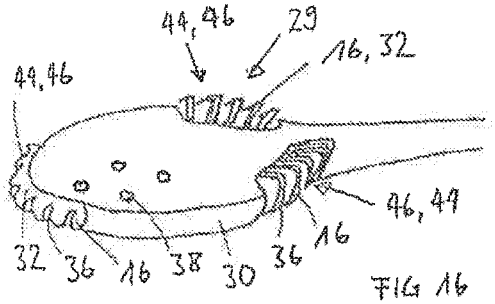
FIGS. 16-21 show examples of different shapes of the flexible area in a toothbrush according to the invention.
Figure 17:
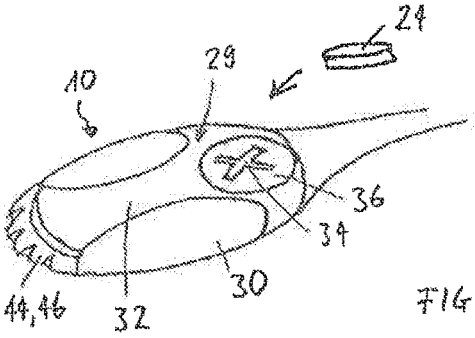
Figure 18:
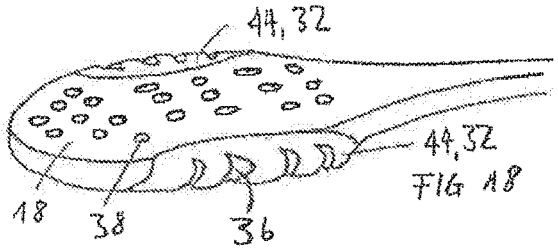
Figure 19:
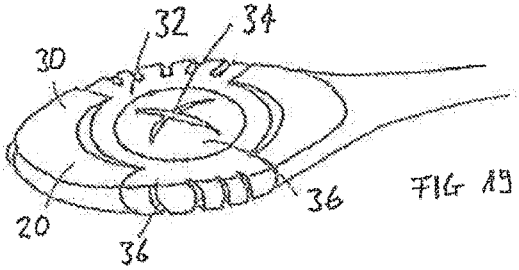
Figure 20:
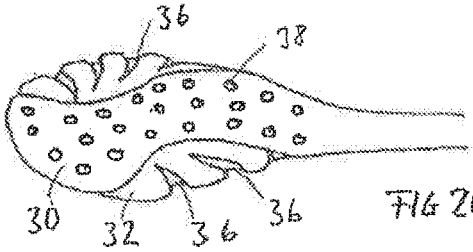
Figure 21:
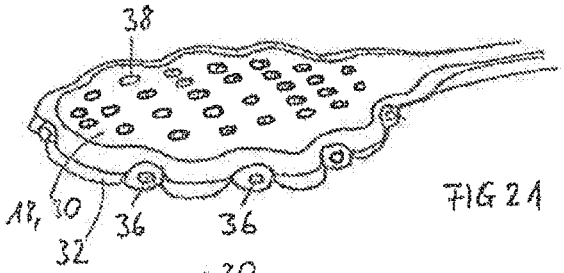

FIGS. 15-21 show examples of different shapes of the flexible zone 29 in a toothbrush according to the invention, in a front view and rear view (FIGS. 16-19), and only in a front view (FIGS. 20 and 21). In all the examples, the rear face once again is provided with an insertion opening 34 formed by intersecting slits, as in FIGS. 5-7 (only shown in some). In FIGS. 16 and 17, the flexible zone 29 has three laterally arranged, gill-like areas 46 (or clusters 44) with lamella-like cleaning/massaging elements 16 and with outlet openings 36 arranged between them. The areas 46 are interconnected on the rear face by a material bridge of soft material 32 (see FIG. 17). In FIGS. 18 and 19, the lamellae/gills are less pronounced, and only two lateral clusters 44 are present. FIG. 20 shows a modification of this, with an asymmetrically curved geometry. In FIG. 21, the outlet openings 36 are distributed uniformly over the lateral edge of the head area 10 and are each surrounded by knobs of soft material, such that a massaging effect is also provided here by the knobs during cleaning of the teeth.

Figure 22:
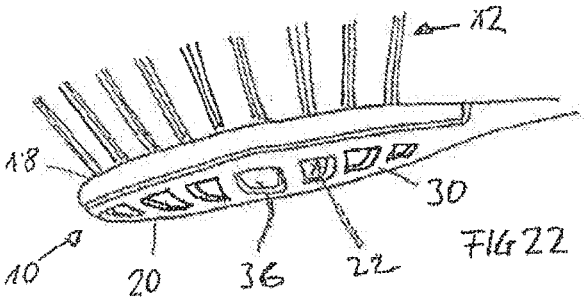
FIGS. 22, 23 show different views of a head part of a toothbrush with outlet openings on the rear face.
Figure 23:
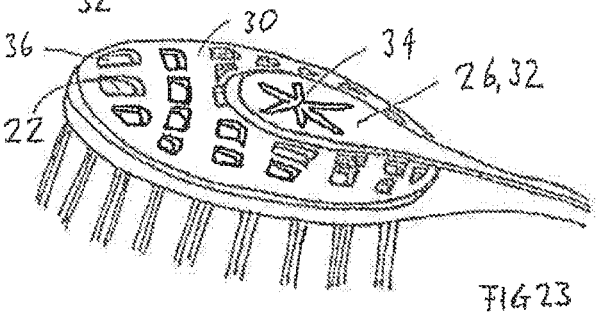

FIGS. 22 and 23 show a brush in a front view and rear view, where the outlet openings 36 are located on the rear face 20 directed away from the bristles and, therefore, the active substance is essentially released on the rear face 20. The rear face 20 is largely made of hard material 30 which is perforated like a mesh and allows a view of the cavity 22 inside the brush head 10. The cavity 22 extends substantially over the whole surface of the head part 10. The sufficient flexibility of the wall of the cavity 22 is achieved by a suitably small material thickness and by the perforations or outlet openings 36. Part of the cavity 22 is covered on the rear face by a membrane 26 of soft material 32 in which slits, arranged in a star shape, serve as insertion opening 34.

Figure 24:
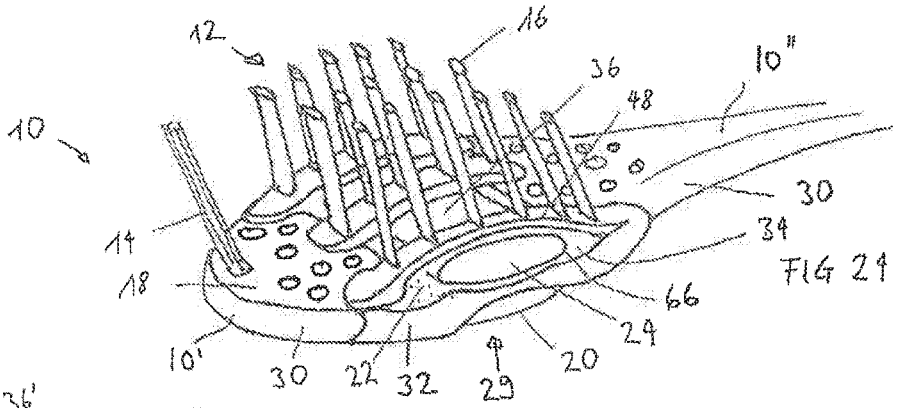
FIGS. 24-27 show examples of different shapes of the active substance element and of cavities adapted to the latter.

In the example shown in FIG. 24, the brush head 10 is composed of two parts (the tip 10', and the area 10" toward the neck) which are made from a hard component 30 and which are connected to one another by a flexible zone 29 made from soft material 32 or from a combination of hard and soft material. A cavity 22 in the shape of a tubular recess with an elliptical cross section is formed in the flexible zone 29. The cavity 22 is delimited toward the front face 18 by three webs 48 of soft material 32. Located between the webs 48 there are two outlet openings 36 with a total width of about half the width of the head. The underside of the cavity 22 is made completely from soft material 32 or from a combination of hard and soft material. Pliable cleaning elements 16 are arranged on the webs 48, while conventional bristles 14 are anchored on the hard areas at the tip and in the area toward the neck. An elliptical insertion opening 34 for the active substance element 24 is formed between the webs 48 and the underside 66 of the cavity 22. The active substance element 24 has basically the shape of a cylinder with an elliptical cross section and rounded edges. The active substance element 24 is clamped between the webs and the underside 66. However, at the sides, it is spaced apart from the inner wall of the cavity 22, such that water washes round it there and in the area of the outlet openings 36. By virtue of the spatial configuration with a substantially two-part hard component 30 and a flexible zone 29 of soft material 32 connecting the parts, the brush head is particularly flexible. Alternatively, the webs 48 can likewise be made from the hard component 30 and can form a hinge-like connection between the tip and the area toward the neck; the flexibility is in this case ensured by the webs 48 having a suitably thin wall.

Figure 25:
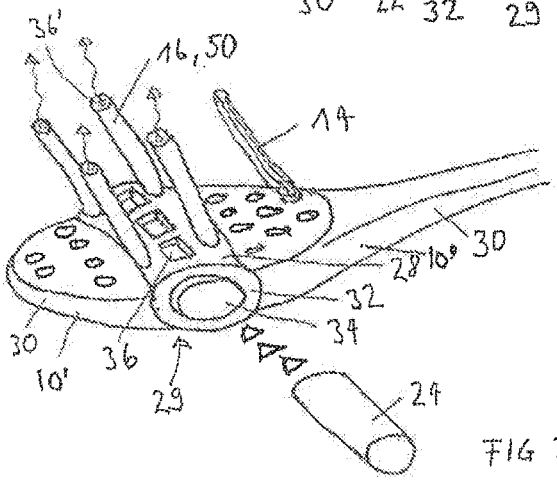
Figure 26:
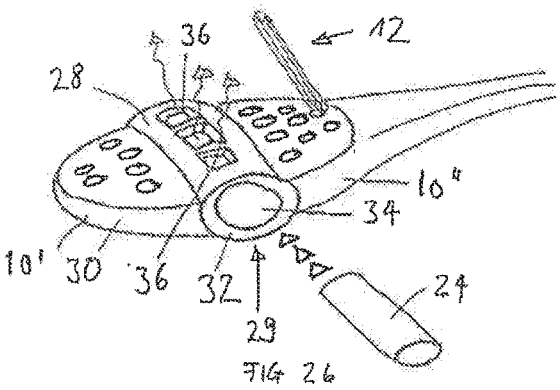
Figure 27:
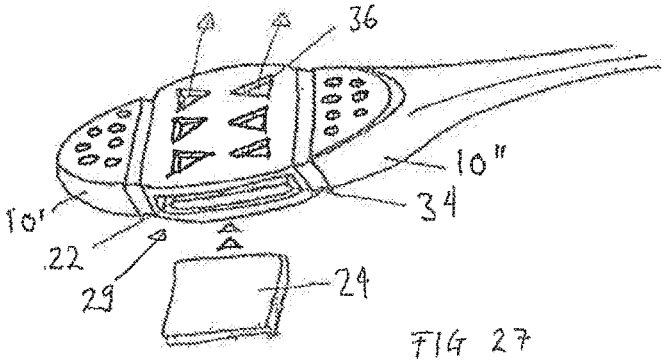

FIGS. 25-27 show modifications of the example from FIG. 24, again with a substantially two-part head area 10 made from a hard component 30 and with a flexible zone 29 which connects the parts 10', 10" and is made from soft component 32 or from a combination of hard and soft component, and in which the cavity 22 for receiving the active substance element 24 is accommodated. In FIGS. 25 and 26, the cavity 22 and the active substance element 24 itself are cylindrical with a circular cross section. The insertion opening 34 is likewise circular and can have a smaller diameter than the cavity 22 itself, such that water can wash at least partially round the active substance element 24 in the cavity 22. In the direction radial to its longitudinal direction, the cavity 22 is substantially surrounded by soft material 32, except for the outlet openings 36 in the membrane 28 on the front face. In the case of FIG. 25, pliable, tubular cleaning elements are formed integrally onto the membrane 28, the interior of these cleaning elements 16 communicating with the cavity 22 in such a way that dissolved active substance is also released via outlet openings 36' at the upper end of the cleaning elements 16. The release of active substance is intensified by the capillary effect. In the case of FIG. 26, no pliable cleaning elements are arranged on the soft component.

FIG. 27 shows an analogous example with an elastic zone 29 which is lengthened in the longitudinal direction of the brush head and in which a substantially cuboid cavity 22 is formed. The latter is adapted to a plate-shaped or film-shaped active substance element 24. In this embodiment variant, the plate-shaped or film-shaped cavity 22 can be applied as a rucksack-shaped structure on the rear face of the brush head. The active substance element 24 has a thickness of 0.01 to 5.0 mm, preferably of 0.05 to 1.0 mm.

In all the examples in FIGS. 24-27, in order to form the tunnel-like cavity for the active substance element, a suitable lateral slide is fitted in the injection-molding tool for the injection molding of the hard and/or soft component.

Figure 28:
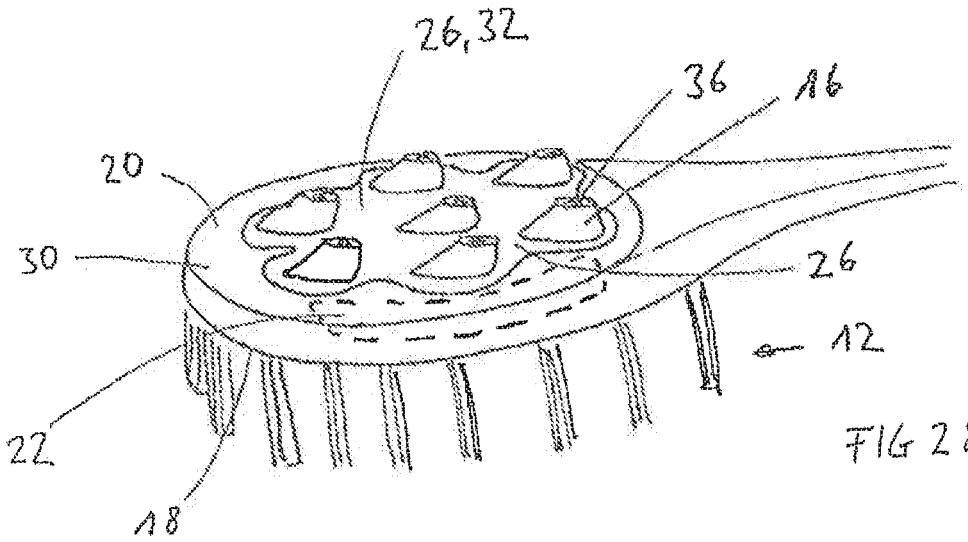
FIG. 28 shows a head part of a toothbrush with funnel-shaped outlet openings on the rear face.

In the example from FIG. 28, the cavity 22 is covered on the rear face 20 of the brush head by a flexible membrane 26 of soft material 32 and is otherwise formed within the hard component 30. The outlet openings 36 on the membrane 26 are formed in knob-like or funnel-like elevations that can at the same time act as cleaning or massaging elements 16, in particular for the palate and the tongue. The front face 18 made from the hard component 30 can thus also be provided conventionally with bristles outside the cavity 22. A combination of this embodiment with a previously shown flexible membrane on the front face of the brush head is also conceivable. The movement of the knobs during cleaning of the teeth means that water is sucked into the cavity and, enriched with active substance, is ejected again.

Figure 29:
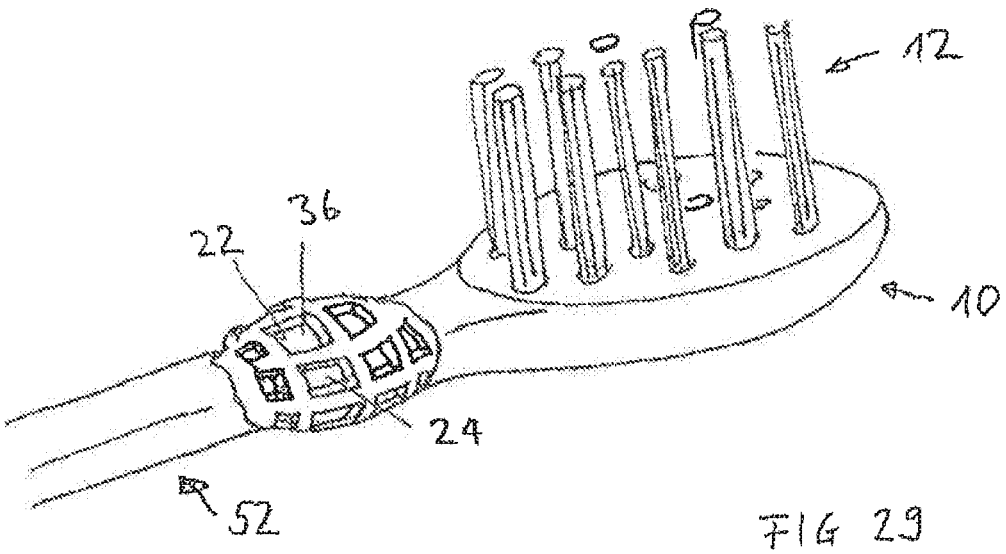
FIG. 29 shows a toothbrush with a cavity in the neck area.

FIG. 29 shows a toothbrush in which the cavity 22 is formed by a cage-like thickening which is provided in the neck area 52 and which is adapted to a spherical or ellipsoid shape of the active substance element. It has a multiplicity of outlet openings 36 through which the cavity 22 can be seen. The boundary of the cavity can be formed from hard and/or soft component, and, in the latter case, a damping zone is obtained in the neck area 52. The flexibility of this zone promotes the pump effect around the active substance element, which effect is discussed in more detail above.

FIGS. 30-33 are schematic representations of different production methods for brushes according to the invention. These production methods can of course be employed for all the embodiment variants shown.

Figure 30:
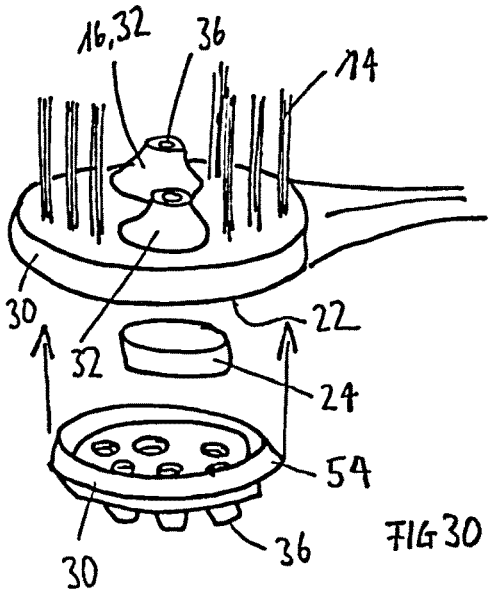
FIGS. 30-32 show different assembly methods for a toothbrush with a cavity.

In FIG. 30, the toothbrush, composed of two parts, is produced from hard and/or soft component 30 in the injection-molding technique, specifically, on the one hand, the upper half of the brush head provided with the bristles, and, on the other hand, the cover 54 on the rear face. A recess for the active substance element 24 is formed in the upper half, and this recess is later closed by the cover 54 to form the cavity 22. On the upper half, the outlet openings 36 and, if appropriate, the cleaning elements 16 are formed from soft component 32. Conventional bristles are anchored, laterally of the cleaning elements 16, by conventional plugging or in-mold tufting (IMT). Further outlet openings 36 are formed in the hard component 30 on the cover 54. Alternatively, the cover 54 can also contain a membrane made from soft component, in which the outlet openings are formed in knob-like elevations. The cover 54 and the rest of the brush head are then connected, with inclusion of a flat active substance element 24, either releasably (snap-fit, sliding fit, locking fit, etc.) or non-releasably (adhesive bonding, welding, positive locking, etc.).

Figure 31:
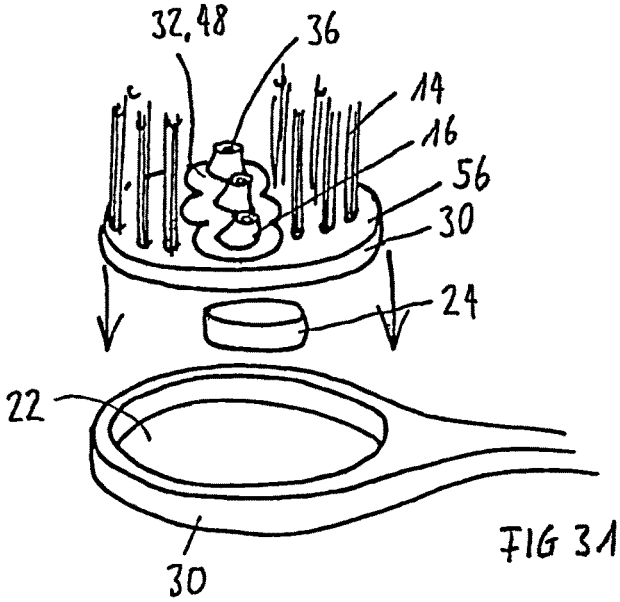

In FIG. 31, the toothbrush is likewise produced as two parts from a hard and/or soft component in the injection-molding technique. The half of the brush head forming its rear face has a saucer-shaped depression which, upon connection to a support plate 56, forms a cavity 22. The support plate is produced including openings which, in a further injection-molding step, are closed with soft component 32 to form a membrane 26 and possibly also with pliable cleaning elements 16 made from soft component. The conventional bristles 14 are then anchored in the support plate 56. Alternatively, the support plate 56 can also be provided with bristles by the anchor-free tufting method, which has the advantage that the support plate can be made thinner. The support plate is then connected to the rest of the toothbrush either releasably (snap-fit, sliding fit, locking fit, etc.) or non-releasably (adhesive bonding, welding, positive locking, etc.), with an active substance element 24 being enclosed in the cavity 22.

Figure 32:
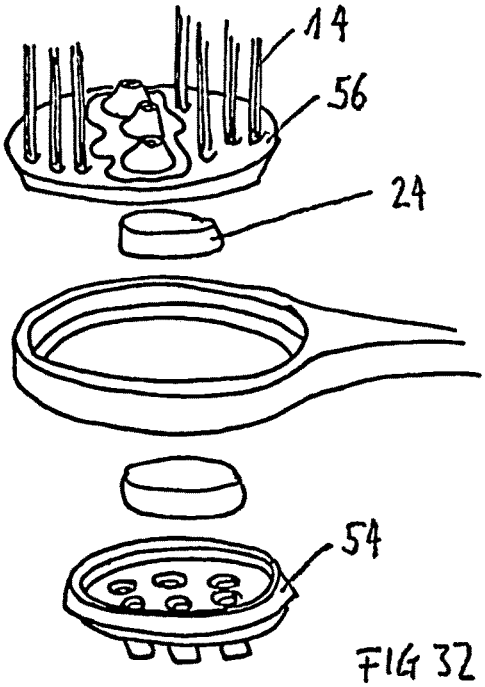

FIG. 32 shows a combination of the examples from FIGS. 30 and 31, with a brush head composed of three parts (annular body, support plate 56 and rear cover 54).

Figure 33:
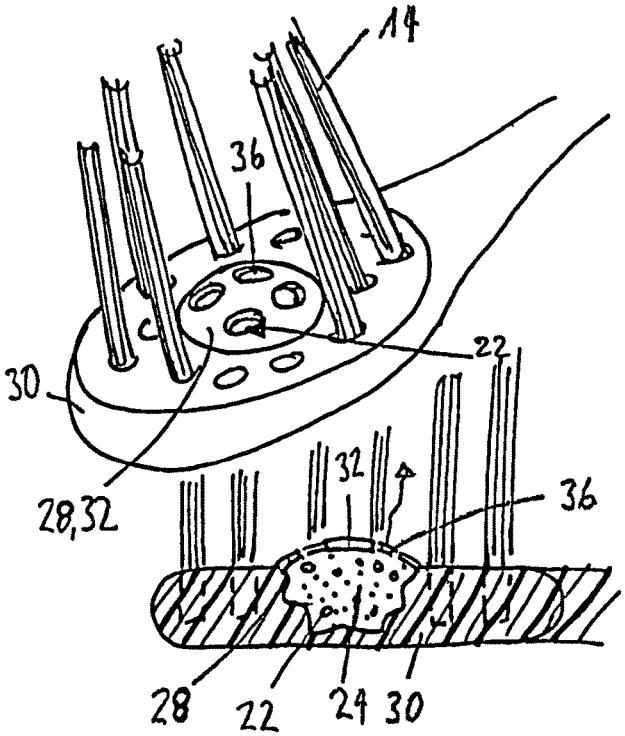
FIG. 33 shows a toothbrush with an active substance element that is encapsulated by injection molding upon production.

FIG. 33 shows a further example in which, during the production of the toothbrush, the active substance is inserted or injected into a recess in the hard component 30, and the soft component 32 is injected over it. By doing so, a cavity 22 with a flexible wall in the form of a thin membrane 26 made from soft component 32 is formed. The membrane 26 is provided with openings 36 for the entry and exit of water or of active substance dissolved in water.

In all the examples, the flexibility of the wall of the cavity 22 is achieved through the choice of a wall material having a certain elasticity, particularly by at least one membrane made of soft material 32 being present, and/or through the existing overall flexural elasticity of the brush made of hard and/or soft material. As long as sufficient contact with water is guaranteed, or sufficient dissolving of the active substance, it suffices if the pump/suction effect, or the change in volume of the cavity due to the cleaning pressure, is only slight or is even non-existent.

FIGS. 34 and 35 show a self-explanatory package 58 for a toothbrush with active substance, which package 58, in addition to having a recess 60 adapted to the brush shape, also comprises a detachable area with an active substance element 24. The user therefore sees immediately what product it is.

The embodiment variants described above can of course also be used on electric toothbrushes. The mechanical movement or vibration of at least part of the brush head additionally favors the exchange of liquid into and out of the cavity. If the brush head is divided into a movable brush-head segment and a non-movable brush-head segment, the cavity, in the above-described variants, is preferably accommodated in the non-movable segment.

FIG. 36 shows a household brush, also with a head part, neck part and handle part 10, 52, 62. In the head area 10 there is a cavity 22 which, on the face directed away from the cleaning structure 12, can be reclosed by a flap 64 and can receive an active substance element 24. The outlet openings for the dissolved active substance are located in the flap 64. In the washing-up brush, a solid soap is preferably inserted as the active substance element. All the embodiment variants described above can be applied analogously to the washing-up brush. The stated dimensions are to be adapted to the dimensions of the brush head.

Combinations of elements from the examples shown also come within the scope of the invention.

A brush with a flexible membrane which is provided in the head part, and which supports cleaning and/or massaging elements, has advantages even without a cavity situated below it, and even without an active substance element inserted in the cavity, particularly because of the flexible suspension of the cleaning and/or massaging elements. All the examples shown can be accordingly modified, for example by no cavity being provided, or by providing a cavity that does not communicate with the outside. For this purpose, the examples shown in FIGS. 1-27 are particularly suitable, in which the flexible zone 29 is retained but has no function in terms of the admission and release of active substance.

The invention claimed is:

1. A toothbrush comprising:

a head part made from a hard material component and a soft material component, the head part including:

a cleaning structure having bristles on a front side of the head part, a handle part, a neck part, and a cavity or a corresponding recess configured to accommodate an active substance element, the cavity or recess having at least one outlet opening configured to release a dissolved active substance from the active substance element during use, wherein:

the at least one outlet opening is located on a rear side of the head part in an area having a soft material structure, and the soft material component has a Shore A hardness of less than 70.

2. The toothbrush as claimed in claim 1, wherein the active substance element contains an injection moldable polymer.

3. The toothbrush as claimed in claim 1, wherein the active substance element is water soluble.

4. The toothbrush as claimed in claim 1, wherein the active substance element contains flavoring agents and/or antibacterial substances.

5. The toothbrush as claimed in claim 1, wherein a rear face of the head part is made of hard material which is perforated like a mesh.

6. The toothbrush as claimed in claim 1, wherein the cavity or the corresponding recess extends substantially over a whole surface of the head part.

7. The toothbrush as claimed in claim 1, wherein a wall of the cavity has a small material thickness and at least one of perforations and outlet openings.

8. The toothbrush as claimed in claim 1, wherein a part of the cavity is covered on the rear face by a membrane of soft material in which slits are arranged in a star shape which serve as insertion opening for the active substance element.

9. A toothbrush comprising:

a head part made from a hard material component and a soft material component, the head part including:

a cleaning structure having bristles on a front side of the head part, a handle part, a neck part, and a cavity or a corresponding recess configured to accommodate an active substance element, the cavity or recess having at least one outlet opening adapted to release a dissolved active substance from the active substance element during use, wherein:

the at least one outlet opening is located on a lateral side of the head part in an area having a soft material structure, and the soft material component has a Shore A hardness of less than 70.

10. The toothbrush as claimed in claim 9, wherein the soft material structure comprises massaging or cleaning elements for invigorating or cleaning the gums, oral cavity or tongue.

11. The toothbrush as claimed in claim 9, wherein the soft material structure is formed as a flexible membrane.

12. The toothbrush as claimed in claim 11, wherein the flexible membrane has a thickness of less than 3 mm.

13. The toothbrush as claimed in claim 11, wherein the flexible membrane has a thickness of 0.7-1.5 mm.

14. The toothbrush as claimed in claim 11, wherein the flexible membrane is bound to a hard material component of the brush head through multi-component injection molding.

15. The toothbrush as claimed in claim 11, wherein the flexible membrane has three laterally arranged, gill-like areas with lamella-like cleaning/massaging elements and with the at least one outlet opening arranged between them.

16. The toothbrush as claimed in claim 15, wherein the gill-like areas are interconnected on the rear face by a material bridge of soft material.

17. The toothbrush as claimed in claim 9, wherein the head part is made from a hard material component and a soft material component.

18. The toothbrush as claimed in claim 9, wherein a rear face of the head part is provided with an insertion opening formed by intersecting slits.

19. The toothbrush as claimed in claim 9, wherein various outlet openings are distributed uniformly over the lateral side of the head part and are each surrounded by knobs of soft material.

20. A toothbrush comprising:

a head part with a cleaning structure, a handle part and a neck part, wherein:

the cleaning structure comprises bristles on a front side of the head part, the head part includes a cavity or a corresponding recess adapted to accommodate an active substance element, the cavity or recess comprising at least one outlet opening adapted to release dissolved active substance from the active substance element during use, the at least one outlet opening is located on a lateral side of the head part in an area comprising a soft material structure, and a rear face of the head part is provided with an insertion opening formed by intersecting slits.

21. A toothbrush comprising:

a head part with a cleaning structure, a handle part and a neck part, wherein:

the cleaning structure comprises bristles on a front side of the head part, the head part includes a cavity or a corresponding recess adapted to accommodate an active substance element, the cavity or recess comprising at least one outlet opening adapted to release dissolved active substance from the active substance element during use, the at least one outlet opening is located on the rear side of the head part in an area comprising a soft material structure, and various outlet openings are distributed uniformly over the lateral side of the head part and are each surrounded by knobs of soft material.

22. A toothbrush comprising:

a head part with a cleaning structure, a handle part and a neck part, wherein:

the cleaning structure comprises bristles on a front side of the head part, the head part includes a cavity or a corresponding recess adapted to accommodate an active substance element, the cavity or recess comprising at least one outlet opening adapted to release dissolved active substance from the active substance element during use, the at least one outlet opening is located on a lateral side of the head part in an area comprising a soft material structure, and various outlet openings are distributed uniformly over the lateral side of the head part and are each surrounded by knobs of soft material.

23. A toothbrush comprising:

a head part with a cleaning structure, a handle part and a neck part, wherein:

the cleaning structure comprises bristles on a front side of the head part, the head part includes a cavity or a corresponding recess adapted to accommodate an active substance element, the cavity or recess comprising at least one outlet opening adapted to release dissolved active substance from the active substance element during use, the at least one outlet opening is located on the rear side of the head part in an area comprising a soft material structure, and the rear face of the head part is largely made of hard material which is perforated like a mesh.

24. A toothbrush comprising:

a head part with a cleaning structure, a handle part and a neck part, wherein:

the cleaning structure comprises bristles on a front side of the head part, the head part includes a cavity or a corresponding recess adapted to accommodate an active substance element, the cavity or recess comprising at least one outlet opening adapted to release dissolved active substance from the active substance element during use, the at least one outlet opening is located on the rear side of the head part in an area comprising a soft material structure, and the wall of the cavity comprises flexibility which is achieved by a suitably small material thickness and by perforations and/or outlet openings.

25. A toothbrush comprising:

a head part with a cleaning structure, a handle part and a neck part, wherein:

the cleaning structure comprises bristles on a front side of the head part, the head part includes a cavity or a corresponding recess adapted to accommodate an active substance element, the cavity or recess comprising at least one outlet opening adapted to release dissolved active substance from the active substance element during use, the at least one outlet opening is located on the rear side of the head part in an area comprising a soft material structure, and a part of the cavity is covered on the rear face by a membrane of soft material in which slits are arranged in a star shape which serve as insertion opening for the active substance element.

26. A toothbrush comprising:

a head part with a cleaning structure, a handle part and a neck part, wherein:

the cleaning structure comprises bristles on a front side of the head part, the head part includes a cavity or a corresponding recess adapted to accommodate an active substance element, the cavity or recess comprising at least one outlet opening adapted to release dissolved active substance from the active substance element during use, the at least one outlet opening is located on a lateral side of the head part in an area comprising a soft material structure, the soft material structure is formed as a flexible membrane, and the flexible membrane has three laterally arranged, gill-like areas with lamella-like cleaning/massaging elements and with the at least one outlet opening arranged between them.

* * * * *